US006087308A

United States Patent [19]

Butler et al.

[11] Patent Number: 6,087,308

[45] **Date of Patent: *Jul. 11, 2000**

[54] NON-SLUDGING, HIGH TEMPERATURE RESISTANT FOOD COMPATIBLE LUBRICANT FOR FOOD PROCESSING MACHINERY

[75] Inventors: Kevin David Butler, Sarnia, Canada; Christopher Jeffrey Still Kent, Baton Rouge, La.

[73] Assignee: Exxon Research and Engineering Company, Florham Park, N.J.

[ * ] Notice: This patent is subject to a terminal disclaimer.

[21] Appl. No.: 09/218,476

[22] Filed: Dec. 22, 1998

[51] Int. Cl.[7] ..... C10M 129/74

[52] U.S. Cl. ..... 508/486

[58] Field of Search ..... 508/486

[56] References Cited

U.S. PATENT DOCUMENTS

| | | | |
|---|---|---|---|
| 2,672,444 | 3/1954 | Wasson et al. | 252/33.4 |
| 2,688,001 | 8/1954 | Echols | 252/49.9 |
| 3,637,774 | 1/1972 | Babayan et al. | 260/410.6 |
| 4,062,785 | 12/1977 | Nibert | 252/49.6 |
| 4,445,813 | 5/1984 | Misra et al. | 413/1 |
| 4,506,533 | 3/1985 | Hessel et al. | 72/42 |
| 4,637,885 | 1/1987 | Kuwamoto et al. | 252/32.5 |
| 4,753,742 | 6/1988 | Wilhelm, Jr. | 252/32.5 |
| 4,767,554 | 8/1988 | Malito et al. | 252/49.5 |
| 4,828,727 | 5/1989 | McAninch | 252/11 |
| 5,102,567 | 4/1992 | Wolf | 508/583 |
| 5,147,764 | 9/1992 | Oppenlaender et al. | 424/401 |
| 5,151,205 | 9/1992 | Culpon, Jr. | 252/56 R |
| 5,185,091 | 2/1993 | Ogake et al. | 252/56.5 |
| 5,380,469 | 1/1995 | Flider | 252/565 |
| 5,578,557 | 11/1996 | Dougan et al. | 508/437 |
| 5,635,457 | 6/1997 | Van Slyke | 507/103 |

FOREIGN PATENT DOCUMENTS

| | | | |
|---|---|---|---|
| 1157846 | 11/1983 | Canada | C10M 1/26 |
| 2195702 | 8/1997 | Canada | C10M 169/04 |
| 0556995 | 8/1993 | European Pat. Off. | C10M 101/04 |
| 0466297 | 6/1994 | European Pat. Off. | C10M 129/76 |
| 0612833 | 8/1994 | European Pat. Off. | C10M 105/40 |
| 0735127 | 10/1996 | European Pat. Off. | C10M 129/76 |
| 60-173097 | 9/1985 | Japan | C10M 129/40 |
| WO94/26404 | 11/1994 | WIPO | B01F 17/00 |

*Primary Examiner*—Jacqueline V. Howard
*Assistant Examiner*—Cephia D. Toomer
*Attorney, Agent, or Firm*—Joseph J. Allocca

[57] ABSTRACT

A lubricating oil suitable for machinery which may come into incidental contact with food is described, which contains a food grade base oil and a combination of food grade additives including a thickener, an antioxidant, a rust inhibitor, an anti-wear additive, an antifoamant, optionally a metal passivator, and 0.2 wt % or less coupling agent. The lubricating oil exhibits good resistance to wear, oxidation and rust, and reduced sludging at equipment surface temperatures of about 200° F. and higher.

3 Claims, No Drawings

NON-SLUDGING, HIGH TEMPERATURE RESISTANT FOOD COMPATIBLE LUBRICANT FOR FOOD PROCESSING MACHINERY

BACKGROUND OF THE INVENTION

1. Field of the Invention

This invention relates to lubricants suitable for use in food processing machinery, comprising a food grade lubricating base oil and a combination of food grade additives to impact good resistance to wear, oxidation and rust and to exhibit improved resistance to sludging in service while retaining the ability to emulsify and/or disperse aqueous and other contaminants.

2. Description of the Related Art

Food grade lubricant systems for use in food processing machinery such as can seamer equipment, conveyor belts, grinders, heaters, ovens, mixers, etc., have long been known and formulated.

U.S. Pat. No. 4,753,742 describes a food grade lubricant comprising food grade mineral oil and 1% to 90% lecithin as well as non-ionic surface active emulsifying agents and vegetable oils.

U.S. Pat. No. 4,506,533 describes a method for drawing and ironing aluminum containers and a lubricant for use in the method, the lubricant comprising unemulsified peanut oil and/or certain oleic acid esters of aliphatic polyhydric alcohols, e.g., sorbitol trioleate.

U.S. Pat. No. 4,445,813 describes a method for forming seamless containers using a lubricant consisting essentially of a fatty acid ester of a mono or polyhydric alcohol.

U.S. Pat. No. 4,767,554 describes a concentrate useful for preparing oil-in-water emulsion lubricants used in drawing and ironing ferrous and non-ferrous metals comprising 60–90 wt % carboxyic acid ester from the group consisting of dibasic acids having at least 70 wt % of the carboxylic acid groups esterified with $C_{4-C30}$ monohydric alcohols and $C_{8-C22}$ mono carboxylic acid ester of a polyhydric alcohol, 0.5–30 wt % water-in-oil emulsifying agent, 2–4 wt % polyglycol co-emulsifier, 0.5–2 wt % phosphate corrosion inhibitor, 0.2–1 wt % copper corrosion inhibitor and 0–10 wt % thickener.

U.S. Pat. No. 5,102,567 describes a food grade lubricating oil which provides superior oxidation, thermal and hydrolytic stability properties and comprises a food grade lubricating oil base stock and a combination of anti oxidants comprising a mixture of food grade phenolic anti oxidants and food grade aminic anti oxidants, each anti oxidant being present in an effective amount of less than about 1.0 wt %. Other additives which may be present include food grade anti wear additives, anti rust additives. Rust inhibitors can be of the ionic or non-ionic type. Ionic types include phosphoric acid ester compounds with amines. Non-ionic types include fatty acids and their esters formed from polyhydric alcohols or polyalkylene glycols, or ethers from fatty alcohols, sorbitan and sorbitan esters alkoxylated with alkylene oxides.

U.S. Pat. No. 5,151,205 describes a lubricant comprising polyalphaolefin base oil and 2–4 wt % polybutene tackifiers.

DESCRIPTION OF THE INVENTION

The present invention is directed to a food grade lubricating composition exhibiting resistance to rust oxidation and wear and an enhanced resistance to sludge formation at metal surface temperatures of about 200° F. and higher, preferably about 220° F. and higher, most preferably about 240° F. and higher. The food grade lubricating composition comprises a major amount of a food grade lubricating base oil and a minor amount of food grade additives, comprising thickeners, anti foamants, phenolic, aminic and/or phosphate anti oxidants, optionally metal passivator additives, anti wear additives, anti rust additives and a coupling agent used at a concentration of less than 0.2 wt % or a mixture of emulsifiers and coupling agents, wherein the mixture of emulsifiers and coupling agents is present in an amount of up to about no more than about 2.5 wt %.

DETAILED DESCRIPTION OF THE INVENTION

In the present invention the food grade base oil is the major component.

The food grade lubricating oil base stock may be selected from 10 to 5000 cSt at 40° C. food grade natural or synthetic base stock oil, preferably 30 to 300 cSt at 40 C. food grade natural or synthetic oil and mixtures thereof.

Natural oil base stock oil is identified as white, oil, a colorless, transparent liquid mixture of n-, iso- and cyclo-paraffins, possibly containing a low level of non-toxic mono-aromatics. The white oil is produced by the distillation of higher boiling petroleum fractions, with initial boiling points typically higher than 300° C.; which fraction is extracted to remove most or all of the aromatics, dewaxed, and hydrotreated to remove sulfur and nitrogen compounds and olefins. Treatment may also include purification using sulfuric acid, caustic soda, decalcination by carbon filtration, etc. The production of white oils is well known in the art, and they are approved for incidental food contact under the U.S. Code of Federal Regulations, 21 CFR 172.878.

Synthetic base stocks suitable for use include food grade polyalphaolefins and stocks useful as thickeners, including polyisobutylene, polybutenes, polyethylenes, or other high viscosity polymers as approved in 21 CFR 178.3570 and 21 CFR 172.882.

The food grade base stock comprises 50 to 100 wt %, preferably 80 to 99 wt %, most preferably 89 to 95 wt % of the lubricating oil base stock used.

As stated above, the base stock may include a quantity of food grade thickener, including polyisobutylene, polybutenes, polyethylenes and other food grade high viscosity polymers, and mixtures thereof, as approved in 21 CFR 178.3570 and 21 CFR 172.882. Depending on the application to which the lubricant will be put and the lubricant viscosity required, the amount of thickener added to the base lubricating oil can range from 0 to 50 wt %, preferably 1 to 20 wt %, most preferably 5 to 11 wt %, based on the final formulation.

Additives suitable for use in food grade lubricating oils are described in general in 21 CFR 178.3570 and also include those substances and materials recited, identified or described in 21 CFR 172.

Food grade anti oxidants include food grade phenolic, aminic, and phosphite anti oxidants.

Suitable phenolic anti oxidants include food grade, sterically hindered phenols and thiophenols, hindered 4-hydroxy and 4-thiolbenzoic acid esters and dithioesters, and hindered bis(4-hydroxy and 4-thiolbenzoic acid and dithio acid) alkylene esters.

Non-limiting examples of useful phenols include 2,6-di tert butyl phenol, 2,6, di-tert butyl p-cresol, 2,6-di-tert amyl-p-cresol, 2-tert butyl 6-tert amyl p-cresol. Butylated hydroxy toluene, BHT, is a commonly used hindered phenol anti oxidant which is approved for incidental food contact. Other hindered phenols include 4,4'methylene bis(2,6 di-tert-butyl phenol), 4,4'dimethylene bis(2,6 di-tert butyl phenol), 4,4'-timethylene bis(2,6-di tert amyl phenol), 4,4'-trimethylene bis(2,6-di tert butyl phenol), 4,4'thio bis phenols, such as 4,4'-thio bis(2,6 di sec-butyl phenol), 4,4'-thio bis(2 tert butyl-6-isopropyl phenol), 4,4'thio bis(2 methyl-6-tert butyl-phenol); 4-alkoxy phenols such as butylated hydroxy anisole, butylated hydroxy phenetole, butylated hydroquinone.

Suitable aminic anti oxidants include the food grade, oil soluble aromatic amine anti oxidants generally represented by phenyl naphthyl amines, alkylated phenyl naphthyl amine, diphenyl amines, alkylated diphenyl amines and N,N'-dialkyl phenylene diamines. Examples of suitable aromatic amine anti oxidants include N-phenyl-alpha-naphthylamine, N-p-methyl phenyl-alpha naphthylamine and di sec butyl diphenyl amine, di isobornyl diphenyl amine, di octyl diphenyl amine, butyl octyl diphenyl amine, etc.

Phosphites include tri-aryl phosphates, such as tris (2,4-di-tert-butyl phenyl) phosphite which is approved for incidental food contact.

Generally, any food grade phenolic, aminic or phosphite anti oxidant can be used.

Food grade anti wear and lubricity enhancing additives can include various oil soluble sulfur and/or phosphorus containing materials known to be effective anti wear materials, and fatty acids and their ester, amine and other derivatives which are known to reduce friction. Thus, sulfur and/or phosphorus containing materials such as triphenyl phosphorothionate, alkylphenyl phosphoric acid esters and their amine derivatives, zinc di alkyl dithiophosphate, zinc di thiocarbamate, amine dithiocarbamate and methylene bis dithiocarbamate, with incidental food contact approval, would be useful anti wear additives. Saturated and unsaturated fatty acids, and other mono- and dicarboxylic acids, and their amides and amine salts, are commonly used as lubricity enhancing additives. Derivatives of such materials are also used, including esters formed with monohydric and polyhydric alcohols, and also reaction products with sulfur.

Food grade metal passivator and deactivator additives may be used, and are advantageous since their presence in the formulation further improves their oxidation resistance, as evidenced by the ROBOT (ASTM D2272) test. Such materials include, but are not limited to, various indoles, pyrazoles, imidazoles, thiazoles, triazoles, benzotriazoles, thiadiazoles, dithiophosphaltes and dithiocarbamates, as well as various chelators and organic acids. Examples would include N,N-dialkyl derivatives of N-methylamino triazoles and benzotriazoles, 2-mercaptobenzothiazole, 2,5-dimercapto-1,3,4-thiadiazole derivatives, N,N'-disalicylidene-1,2-propanediamine and gluconic acid. A suitable metal passivator additive for this purpose, which is approved for incidental food contact, is Irgamet 39 manufactured by Ciba Specialty Chemicals.

Food grade rust inhibiting additives include various ionic and non-ionic surface active agents. Ionic anti-rust additives include phosphoric acid, mono- and di-hexyl esters, compounds with tetramethyl nonyl amines and $C_{10}$ to $C_{18}$ alkyl amines, and also $C_1$–$C_{10}$ alkylated phosphates and phosphites. Irgalube 349, an amine phosphate anti-rust additive (available from Ciba Specialty Chemicals), which also exhibits anti-wear performance, and is approved for incidental food contact, is a typical useful example of such a material.

Food grade non-ionic anti rust additives include food grade fatty acids and their esters. Thus, esters of sorbitan, glycerol, other polyhydric alcohols or polyalkylene glycols may be used. Food grade esters from fatty alcohols alkoxylated with alkylene oxides, or sorbitan alkoxylated with alkylene oxides, or sorbitan ester alkoxylated with alkylene oxides are additional useful examples. Various derivatives of succinic acid or succinic anhydride, formed by reaction with fatty acids and or amines, are also useful anti-rust additives. Examples of non ionic anti rust additives include sorbitan mono-oleate, ethoxylated vegetable oil, ethoxylated fatty acids, ethoxylated fatty alcohols, fatty glyceride esters, polyoxy ethylene sorbitan mono-oleate, polyoxyethylene sorbitan, glycerol mono oleate, glycerol di oleate, glycerol mono stearate, glycerol di stearate. Span 80 (sorbitan mono-oleate) is a typical non-ionic anti rust additive approved for food grade oils, which is also useful as an emulsifier in the present formulation, the function of which is described below.

In the present invention, a necessary component is a coupling agent used at a concentration of less than about 0.2 wt % or an emulsifier/coupling agent system. A wide range of oil-soluble ionic and non-ionic materials are available to act as emulsifiers and coupling agents, with the actual selection of suitable materials generally based on the nature of the oil and the contaminants to be emulsified or dispersed. These other materials include many possible types of liquids and solids which compose the food materials that are being processed, and include, but are not limited to, sugars, fats, acids, proteins and chemical additives such as food processing aids, flavor modifiers and preservatives. Any chemical additive that has a dual hydrophobic-hydrophilic nature, and is able to reduce the interfacial tension between the two liquid phases, is particularly suitable as an emulsifier. Resulting emulsions may be of either the water-in-oil or oil-in-water type. In applying the present invention the aqueous materials will generally be contaminants, and therefore less abundant than the oil, so that water-in-oil emulsions will most likely result. In addition, a coupling agent is employed to further disperse hydrophilic and other contaminant materials by chemically associating or coupling them to the lubricating oil. In this way the invention provides a means of removing the contaminants from the food equipment by dispersing them in the oil, and thus preventing damage to the food processing equipment resulting from blocking of passages and filters through which the lubricant passes, or reduction of the fluction of the lubricant, or damage to the lubricated metal surfaces by corrosion, deposition or wear.

A wide range of oil-soluble emulsifying agents is commercially available, including both ionic and non-ionic types. Ionic emulsifiers include, but are not limited to, organic and inorganic sulfonates, such as alkylammonium and sodium nonylnaphthylene sulfonates; alkylammonium salts of fatty acids (such as lauric, palmitic, oleic, linoleic, linolenic, erucic, stearic acids and the like) and other organic acids, especially those containing long hydrocarbon chains; and phosphate esters of alkoxylated alcohols. Non-ionic emulsifiers include, but are not limited to, polyhydric alcohols and derivatives formed by reaction with amines, fatty acids and other organic acids, and/or ethylene, propylene and/or butylene oxides. Fatty acid esters of sugars, e.g., oleate esters of sugars are particularly effective, such as Span 80 (sorbitan mono-oleate), as was described above. Certain alkylene glycols and their ester or amine derivatives are also suitable, as are poly-oxy ethylene, propylene or butylene oxide derivatives of organic amines, such as ethylenediamine, or of alkylphenols. Other effective emulsifiers include tall oil fatty acids, mono-, di- and triethanolamides, butyl cellosolve, and various natural and synthetic gums such as hydroxyalkyl cellulose and carboxyvinyl polymers.

Coupling agents can have chemical compositions broadly similar to that of emulsifiers, but have different composition features which enhance their function of chemically associating with contaminant materials. Thus, such agents are commonly based on polyhydric alcohols which are of higher molecular weight and/or are less hydrophilic than corresponding emulsifiers, in order to strengthen their association with less hydrophilic materials, such as fats. Thus, in this text and the following claims it is to be understood that if both the coupling agent and the emulsifier are polyhydric alcohols or derivatives thereof, they are not both the same but are different polyhydric alcohols or derivatives thereof, with the coupling agent being the polyhydric alcohol or derivative thereof of higher molecular weight and/or less hydrophilic in nature. Similarly, poly-glycerols are often more effective coupling agents than mono-glycerol, their fatty acid ester derivatives are especially effective, and oleic acid ester derivatives are highly preferred. Witconol 14F, available from Vitro Corporation, is an example of a suitable food grade coupling agent. This material is an oleic acid ester of a glycerol oligomer, containing an average of four glycerol and two oleic acid units, and is also known as polyglyceryl-4-oleate.

The amounts of emulsifier and coupling agent required are dependent on the chemical nature of the additives, and can vary widely.

In the present formulation the base oil comprises 80 to 99.9 wt % of the total formulation, preferably 95 to 99.6 wt %, with additives comprising the balance.

Thickener, as used in the present invention, is indicated to constitute part of the base oil. Thickener is used as needed to give the final product the necessary viscosity. Thus, depending on the viscosity of the lubricating base oil, the practitioner may choose to use anywhere from zero to up to 50 wt % of an appropriate molecular weight thickener to give a final base oil having the desired final viscosity.

Phenolic anti-oxidants, aminic anti oxidants, phosphite anti oxidants or mixtures thereof can be added to the formulation in an amount in the range of 0.05 to 5 wt %, preferably 0.2 to 2.0 wt %, based on the total formulation.

Anti wear agents can be added to the formulation in an amount in the range of 0.02 to 2.5 wt %, preferably 0.1 to 1.0 wt %, based on the total formulation.

Anti rust agents can be added to the formulation in an amount in the range of 0.01 to 1.0 wt %, preferably 0.05 to 0.40 wt %, based on the total formulation, provided the anti rust agent is not also of the proper chemistry to function as an emulsifying agent. If the anti rust agent is non ionic and can also function as an emulsifying agent (e.g., the anti rust agent is sorbitan mono oleate (Span 80)) then the amount of such material used in toto in the formulation is governed by its function as an emulsifying agent and the amount of such material used is set by the amount of emulsifying agent which may be present in the formulation, a maximum total amount of 1.0 wt %, as further discussed below.

In order for the formulation to be resistant to the formation of sludge at surface temperatures of about 200° F. and higher, preferably about 220° F. and higher, most preferably about 240° F. and higher, it has been discovered that the amount of coupling agent used or the combined amount of emulsifier and coupling agent used must be carefully controlled. At very low levels of coupling agent or of the total emulsifier/coupling agent mixture, the oil will have very little tendency to emulsify, while at very high levels it will tend to form a thick gel structure. In order to stay within the desirable region of concentration where a moderately stable emulsion/dispersion is formed, the combined amount of emulsifier and coupling agent type additives added to the formulation is an amount of no more than about 2.5 wt % of the total formulation, preferably no more than 1.1 wt % of the total formulation, more preferably no more than 0.40 wt % of the total formulation, most preferably about 0.08 to 0.25 wt % of the total formulation. In general, equal amounts of emulsifier and coupling agent can be used, but it is preferred that the amount of emulsifier used be less than the amount of coupling agent used in the mixture of emulsifier and coupling agent.

The amount of emulsifier additive used generally ranges from about 0.005 to 1.0 wt %, preferably about 0.01 to 0.10 wt %, more preferably about 0.01 to 0.05 wt % of the total formulation, while the amount of coupling agent used in the combination generally ranges from about 0.03 to 1.5 wt %, preferably about 0.07 to 0.30 wt % of the total formulation, more preferably about 0.1 to 0.2 wt % of the total formulation. When used alone the amount of coupling agent used is less than 0.2 wt %, preferably 0.01 to 0.175 wt % more preferably about 0.05 to 0.15 wt %.

The present formulation has particular utility for use in can seamer equipment, such equipment being used to seal the lid on aluminum, steel or tin plate cans containing such products as soda, beer, fruit and vegetable juices and drinks, as well as processed raw fruits and vegetables in their packing liquid.

An important feature of the invention is the ability of the oil to incorporate low to moderate levels, e.g., up to about 35%, of aqueous contaminants, such as the beverages or packing liquid. In this way the contaminants will be removed from the lubrication system of the machinery by the flow of the lubricating oil, and also the contaminants will be released from the lube oil in a relatively short period of time (on standing) so that the lubricating oil can be recycled. These features are achieved through the use of the novel emulsifier/coupling agent system which provides enhanced solubility and/or dispersion of the contaminants while the lubricating oil is in motion.

Modern, high operating temperature machines operating at a can throughput rate of 1000 to 2000 cans/minute and higher, where equipment surface temperatures can reach 200° F. and higher, usually 220° F. and higher and even 240° F. and higher, place an extreme operational burden on the lubricating oil used.

In lubricating oils intended for use in such harsh environments the oil and all other ingredients must be chosen so as to resist both evaporation and deterioration under the conditions of operation.

Oils which in the past had been useful in slower machines operating at lower equipment surface temperatures proved incapable of satisfactorily functioning in the newer high speed machines.

EXAMPLES

Example 1

Three oils were prepared and evaluated for oxidation life (ASTM D2272, RBOT), rust performance (ASTM D665B), wear (ASTM D4172 four-ball wear test) and emulsibility (modified ASTM D1401).

Oil A, the oil of the present invention, had the following compositional make-up:

| Wt % | Component Identity | Component Type |
|---|---|---|
| 90.168 | USP White Oil 650 | Severely hydrotreated petroleum base oil |
| 9.0 | Indopol H-300 | Poly-isobutylene |
| 0.002 | Rhodorsil 47V 500 Si | Polymethylsiloxane antifoam additive |
| 0.5 | Irganox L109 | Phenolic antioxidant |
| 0.2 | Irgalube 349 | Amine phosphate antiwear additive |

-continued

| Wt % | Component Identity | Component Type |
|---|---|---|
| 0.1 | Witconol 14F | Polyglycerol oleate coupling agent |
| 0.02 | Span 80 | Sorbitan mono-oleate emulsifier |

Oil B is similar to Oil A, but contains no Span 80 emulsifier or Witconol 14F coupling agent.

Oil C is also similar to Oil A but contains 2 wt % Span 80 emulsifier and 2 wt % Witconol 14F coupling agent, and is an example of a commercial oil which was used successfully in lower speed/lower temperature machinery.

The performance of these oils are reported as follows:

| Property | Oil A | Oil B | Oil C | Requirement* |
|---|---|---|---|---|
| Kinematic Viscosity @ 40° C., cSt | 150 | 150 | 150 | |
| Viscosity | 97 | 97 | 97 | |
| RBOT life (ASTM D2272), minutes | 182 | 205 | 48 | >150 |
| Rust Performance (ASTM D665B) | pass | pass | pass | pass |
| 4-Ball Wear (ASTM D4172), mm | 0.32 | 0.34 | 0.40 | ≦0.40 |
| Emulsibility (modified D1401 test**) | | | | |
| emulsion (ml) @ 0 minutes | 80 | 80 | 80 | |
| emulsion (ml) @ 5 minutes | 78 | 68 | 78 | |
| emulsion (ml) @ 10 minutes | 78 | 3 | 78 | |
| emulsion (ml) @ 30 minutes | 3 | 4 | 73 | |
| nature of emulsion @ 30 minutes | fluid | none | thick | fluid |

Measured properties for Oil A indicated that it would provide good wear performance (ASTM D4172), good anti-rust performance (D665B) and good oxidation resistance (D2272). Oil A also formed a very fluid emulsion in the modified D 1401 test.
*Requirements set from guidelines, but not specific limits, provided by can seamer equipment manufacturers.
**Modified ASTM D1401 test used 16:64 ml carbonated beverage:oil at 82° C. (~180° F.), 2 minutes stirring.

It can be seen that all the oils emulsified readily when vigorously stirred in the modified ASTM D1401 test, but when no emulsifier or coupling agent additives were present (Oil B), oil/beverage separation occurred rapidly upon standing. This is not desirable in so far that if the emulsion breaks down immediately, the aqueous contaminants will settle and not be swept from the lube system. The preferred behavior criterion in this test is that the oil stays emulsified for at least 10 minutes after stirring is complete, but substantially separates upon standing for between 10 and 30 minutes. In addition, the nature of the emulsion formed should be fluid, not thick and immobile, so that it would be readily swept from the lube system. In the invention formulation (Oil A) a significant amount of emulsion remained after 10 minutes, indicating that it had good capacity for absorbing aqueous contaminants; and it remained fluid for longer than 30 minutes. The oil with the highest treat levels of emulsifying additives (Oil C) showed little tendency to separate, even after :30 minutes, and this oil formed a thick immobile emulsion in the test, which would indicate that it would not be readily swept from a lube system. This is believed to be the reason that a high speed can seamer machine in actual operation, using an oil similar to Oil C, formed oxidized sludge derived from the thick, immobile emulsion.

Example 2

Other commercial oils on the market were also tested in key performance bench tests, with the following results.

| Identity of Oil Property | Oil CA Aeroshell 100 | Oil CB Lubriplate FMO 900 AW | Oil CC Jax Magnaplate 78 | Oil CD Chevron FM 100 | Oil CE Chevron FM-E100 |
|---|---|---|---|---|---|
| Approved for incidental food contact | no | yes | yes | yes | yes |
| Kinematic Viscosity @ 40° C., cSt | 233 | 171 | 146 | 97 | 93 |
| Viscosity Index | 93 | 98 | 97 | 106 | 122 |
| RBOT life (ASTM D2272), minutes | 80 | 495 | 52 | 173 | 292 |
| Rust Performance (ASTM D665B) | fail | fail | pass | pass | pass |
| 4-Ball Wear (ASTM D4172), mm | 0.70 | 0.42 | 0.36 | 0.41 | 0.47 |
| Emulsibility (ASTM D1401 @ 82° C.) | | | | | |
| emulsion (ml) @ 0 minutes | 80 | 80 | 80 | 80 | 80 |
| emulsion (ml) @ 5 minutes | 80 | 72 | 79 | 74 | 6 |
| emulsion (ml) @ 10 minutes | 80 | 3 | 2 | 58 | 2 |
| emulsion (ml) @ 30 minutes | 75 | 2 | 2 | 29 | 2 |
| ability to absorb aqueous contaminants | good | poor | poor | fair | poor |
| nature of emulsion @ 10–30 minutes | fluid | none | none | thick | none |

It can be seen that none of the competitor oils simultaneously meet all of the criteria for demonstrating good wear, rust and oxidation performance, as well as the ability to absorb aqueous contaminants and form a fluid emulsion; and also be approved for incidental food contact.

Example 3

The effect of varying the type of anti oxidant and of adding a metal passivator to the formulation was also investigated.

In this Example, Oil A from Example 1 is compared against Oil B from Example 1, and also against Oil D which is similar to Oil A but further contains Irgamet 39 metal passivator (N,N-dioctyl amino methyl 1,2,4 benzo triazole); and Oil E which is similar to Oil A but substitutes Irganox L115, a sulfur containing phenolic antioxidant, for Irganox L109 (a standard phenolic anti oxidant).

The results are presented below:

| | Oil B | Oil A | Oil D | Oil E |
|---|---|---|---|---|
| Components (mass %) | | | | |
| USP White Oil 650 | 90.298 | 90.178 | 90.098 | 90.178 |
| Indopol H-300 | 9.0 | 9.0 | 9.0 | 9.0 |
| Rhodorsil 47V 500 Si Fluid | 0.002 | 0.002 | 0.002 | 0.002 |
| Irganox L109 | 0.5 | 0.5 | 0.5 | — |
| Irganox L115 | — | — | — | 0.5 |
| Irgamet 39 | — | — | 0.08 | — |
| Irgalube 349 | 0.2 | 0.2 | 0.2 | 0.2 |
| Span 80 | — | 0.02 | 0.02 | 0.02 |
| Witconol 14F | — | 0.1 | 0.1 | 0.1 |
| Test | | | | |
| RBOT (ASTM D2272), minutes | 205 | 182 | 263 | 195 |

Example 4

Different food grade oil formulations containing various levels of Span 80 emulsifier and/or Witconol 14F coupling agent were evaluated for emulsion quality. Formulations containing either the Span 80 or Witconol 14F alone formed thick emulsions and/or emulsions which did not separate in 30 minutes.

A formulation which contained 2 wt % of each of Span 80 and Witconol 14F (for total of 4 wt %) formed a thick emulsion which did not separate in 30 minutes.

Formulations with lesser but equal amounts of Span 80 and Witconol 14F were either still thick, or were fluid but did not completely separate in the 30 minute test period.

Formulations containing lesser amounts of Span 80 and Witconol 14F, with the Witconol 14F being the major component of the emulsifier/coupling agent pair, were found to give partially to fully fluid emulsions, with significantly improved emulsion separation in the 30 minute test time period.

The test results are summarized in the table below.

| Sample Number | Wt % Witconol 14F | Wt % Span 80 | ml of Emulsion in modified D1401 Test After Settling Times Shown 0 Minutes | 5 Minutes | 10 Minutes | 30 Minutes | Emulsion Appearance @ 30 Minutes |
|---|---|---|---|---|---|---|---|
| No Emulsifiers | | | | | | | |
| 1 | 0 | 0 | 80 | 80 | 68 | 3 | none |
| Single Emulsifier/Coupling Additive | | | | | | | |
| 2 | 0.5 | 0 | 80 | 77 | 72 | 47 | thick |
| 3 | 0 | 0.5 | 80 | 78 | 78 | 75 | fluid |
| 4 | 0.2 | 0 | 80 | 79 | 25 | 6 | thick |
| 5 | 0 | 0.2 | 80 | 78 | 74 | 2 | thick |
| Equal Treat Levels of Emulsifier and Coupling Additives | | | | | | | |
| Oil C | 2 | 2 | 80 | 78 | 78 | 73 | thick |
| 7 | 0.5 | 0.5 | 80 | 78 | 78 | 67 | thick |
| 8 | 0.2 | 0.2 | 80 | 76 | 64 | 39 | fluid |
| Different Treat Levels of Emulsifier and Coupling Additives | | | | | | | |
| 9 | 0.2 | 0.1 | 80 | 75 | 65 | 23 | semi-fluid |
| 10 | 0.2 | 0.05 | 80 | 78 | 60 | 28 | semi-fluid |
| Oil A | 0.1 | 0.02 | 80 | 78 | 78 | 3 | fluid |

What is claimed is:

1. A method for reducing sludge formation in food grade lubricating oils used in food processing equipment operating at metal surface temperatures of about 200° F. and higher comprising adding to such a food grade lubricant comprising a major amount of a food grade lubricating oil a minor amount of a coupling agent selected from polyglycerol fatty acid esters, wherein said coupling agent is added to the food grade lubricant in an amount of less than 0.2 wt %.

2. The method of claim 1 wherein the coupling agent is an oleic acid ester of a glycerol oligomer containing an average of four glycerol and two oleic acid units.

3. The method of claim 1 or 2 wherein the coupling agent is added to the food grade lubricant in an amount in the range 0.01 to 0.15 wt %.

* * * * *